US011125039B2

(12) United States Patent
Kellner

(10) Patent No.: US 11,125,039 B2
(45) Date of Patent: Sep. 21, 2021

(54) DEFORMABLE DOWNHOLE TOOL WITH DISSOLVABLE ELEMENT AND BRITTLE PROTECTIVE LAYER

(71) Applicant: INNOVEX DOWNHOLE SOLUTIONS, INC., Houston, TX (US)

(72) Inventor: Justin Kellner, Adkins, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 16/677,993

(22) Filed: Nov. 8, 2019

(65) Prior Publication Data

US 2020/0149366 A1 May 14, 2020

Related U.S. Application Data

(60) Provisional application No. 62/758,073, filed on Nov. 9, 2018.

(51) Int. Cl.
*E21B 33/128* (2006.01)
*E21B 29/02* (2006.01)

(52) U.S. Cl.
CPC ..... *E21B 29/02* (2013.01); *E21B 33/128* (2013.01)

(58) Field of Classification Search
CPC ..... E21B 29/02; E21B 33/128
USPC ..... 166/376
See application file for complete search history.

(56) References Cited

U.S. PATENT DOCUMENTS 2,189,697 A 2/1940 Baker
2,222,233 A 11/1940 Mize
2,225,143 A 12/1940 Baker et al.
3,127,198 A 3/1964 Orund
3,746,093 A 7/1973 Mullins
3,860,067 A 1/1975 Rodgers
4,155,404 A 5/1979 Hollingsworth
4,483,399 A 11/1984 Colgate
4,901,794 A 2/1990 Baugh et al.
5,064,164 A 11/1991 Le
5,131,468 A 7/1992 Lane et al.
5,325,923 A 7/1994 Surjaatmadja et al.
5,396,957 A 3/1995 Surjaatmadja et al.
(Continued)

FOREIGN PATENT DOCUMENTS

AR 091776 A1 2/2015
AU 2010214651 A1 3/2012
(Continued)

OTHER PUBLICATIONS

Anjum et al., Solid Expandable Tubular Combined with Swellable Elastomers Facilitate Multizonal Isolation and Fracturing, with Nothing Left in the Well Bore to Drill for Efficient Development of Tight Gas Reservoirs in Cost Effective Way, SPE International Oil & Gas Conference, Jun. 8-10, 2010, pp. 1-16.
(Continued)

*Primary Examiner* — Taras P Bemko
(74) *Attorney, Agent, or Firm* — MH2 Technology Law Group LLP

(57) ABSTRACT

A downhole tool includes a component that is configured to dissolve in a wellbore fluid, and a protective coating applied to the component. The protective coating is configured to isolate the component from the wellbore fluid, and to fracture in response to the component deforming and expose the component to the wellbore fluid.

18 Claims, 2 Drawing Sheets

(56) References Cited

U.S. PATENT DOCUMENTS 5,479,986 A 1/1996 Gano et al.
5,542,473 A 8/1996 Pringle
5,623,993 A 4/1997 Buskirk et al.
5,701,959 A 12/1997 Hushbeck et al.
5,709,269 A 1/1998 Head
5,984,007 A 11/1999 Yuan et al.
6,167,963 B1 1/2001 McMahan et al.
6,220,349 B1 4/2001 Vargus et al.
6,296,054 B1 10/2001 Kunz et al.
6,354,372 B1 3/2002 Carisella et al.
6,354,373 B1 3/2002 Vercaemer et al.
6,446,323 B1 9/2002 Metcalfe et al.
6,581,681 B1 6/2003 Zimmerman et al.
6,662,876 B2 12/2003 Lauritzen
6,684,958 B2 2/2004 Williams et al.
6,695,050 B2 2/2004 Winslow et al.
6,702,029 B2 3/2004 Metcalfe et al.
6,712,153 B2 3/2004 Turley et al.
6,722,437 B2 4/2004 Vercaemer et al.
6,793,022 B2 9/2004 Vick et al.
6,796,376 B2 9/2004 Frazier
6,796,534 B2 9/2004 Beyer et al.
7,048,065 B2 5/2006 Badrak et al.
7,093,656 B2 8/2006 Maguire
7,096,938 B2 8/2006 Carmody et al.
7,104,322 B2 9/2006 Whanger et al.
7,150,318 B2 12/2006 Freeman
7,168,494 B2 1/2007 Starr et al.
7,168,499 B2 1/2007 Cook et al.
7,172,025 B2 2/2007 Eckerlin
7,195,073 B2 3/2007 Fraser, III
7,255,178 B2 8/2007 Slup et al.
7,273,110 B2 9/2007 Pedersen et al.
7,322,416 B2 1/2008 Burris, II et al.
7,350,582 B2 4/2008 McKeachnie et al.
7,350,588 B2 4/2008 Abercrombie Simpson et al.
7,363,967 B2 4/2008 Burris, II et al.
7,367,389 B2 5/2008 Duggan et al.
7,367,391 B1 5/2008 Stuart et al.
7,373,990 B2 5/2008 Harrall et al.
7,395,856 B2 7/2008 Murray
7,422,060 B2 9/2008 Hammami et al.
7,451,815 B2 11/2008 Hailey, Jr.
7,464,764 B2 12/2008 Xu
7,475,736 B2 1/2009 Lehr et al.
7,503,392 B2 3/2009 King et al.
7,520,335 B2 4/2009 Richard et al.
7,527,095 B2 5/2009 Bloess et al.
7,530,582 B2 5/2009 Truchsess et al.
7,552,766 B2 6/2009 Gazewood
7,562,704 B2 7/2009 Wood et al.
7,584,790 B2 9/2009 Johnson
7,603,758 B2 10/2009 Cook et al.
7,607,476 B2 10/2009 Tom et al.
7,614,448 B2 11/2009 Swagerty et al.
7,647,964 B2 1/2010 Akbar et al.
7,661,481 B2 2/2010 Todd et al.
7,665,537 B2 2/2010 Patel et al.
7,665,538 B2 2/2010 Robisson et al.
7,690,436 B2 4/2010 Turley et al.
7,757,758 B2 7/2010 O'Malley et al.
7,798,236 B2 9/2010 McKeachnie et al.
7,814,978 B2 10/2010 Steele et al.
7,832,477 B2 11/2010 Cavender et al.
7,861,744 B2 1/2011 Fly et al.
7,861,774 B2 1/2011 Fehr et al.
7,921,925 B2 4/2011 Maguire et al.
7,980,300 B2 7/2011 Roberts et al.
8,016,032 B2 9/2011 Mandrell et al.
8,047,279 B2 11/2011 Barlow et al.
8,079,413 B2 12/2011 Frazier
8,267,177 B1 9/2012 Vogel et al.
8,276,670 B2 10/2012 Patel
8,291,982 B2 10/2012 Murray et al.
8,307,892 B2 11/2012 Frazier
8,327,931 B2 12/2012 Agrawal et al.
8,336,616 B1 12/2012 McClinton
8,397,820 B2 3/2013 Fehr et al.
8,403,037 B2 3/2013 Agrawal et al.
8,425,651 B2 4/2013 Xu et al.
8,459,347 B2 6/2013 Stout
8,567,494 B2 10/2013 Rytlewski et al.
8,573,295 B2 11/2013 Johnson et al.
8,579,024 B2 11/2013 Mailand et al.
8,631,876 B2 1/2014 Xu et al.
8,636,074 B2 1/2014 Nutley et al.
8,684,096 B2 4/2014 Harris et al.
8,776,884 B2 7/2014 Xu et al.
8,887,818 B1 11/2014 Carr et al.
8,905,149 B2 12/2014 Bailey et al.
8,936,085 B2 1/2015 Boney et al.
8,950,504 B2 2/2015 Xu et al.
8,978,776 B2 3/2015 Spray
8,991,485 B2 3/2015 Chenault et al.
9,010,416 B2 4/2015 Xu et al.
9,016,363 B2 4/2015 Xu et al.
9,033,041 B2 5/2015 Baihly et al.
9,033,060 B2 5/2015 Xu et al.
9,057,260 B2 6/2015 Kelbie et al.
9,080,403 B2 7/2015 Xu et al.
9,080,439 B2 7/2015 O'Malley et al.
9,101,978 B2 8/2015 Xu et al.
9,206,659 B2 12/2015 Zhang et al.
9,228,404 B1 1/2016 Jackson et al.
9,309,733 B2 4/2016 Xu et al.
9,334,702 B2 5/2016 Allen et al.
9,382,790 B2 7/2016 Bertoja et al.
D762,737 S 8/2016 Fitzhugh
D763,324 S 8/2016 Fitzhugh
9,470,060 B2 10/2016 Young
9,574,415 B2 2/2017 Xu et al.
9,605,508 B2 3/2017 Xu et al.
D783,133 S 4/2017 Fitzhugh
9,752,423 B2 9/2017 Lynk
9,835,003 B2 12/2017 Harris
D807,991 S 1/2018 Fitzhugh
9,909,384 B2 3/2018 Chauffe et al.
9,927,058 B2 3/2018 Sue
9,976,379 B2 5/2018 Schmidt
9,976,381 B2 5/2018 Martin et al.
D827,000 S 8/2018 Van Lue
10,156,119 B2 12/2018 Martin et al.
10,400,531 B2 9/2019 Jackson et al.
10,408,012 B2 9/2019 Martin et al.
10,415,336 B2 9/2019 Benzie
10,533,392 B2 1/2020 Walton
10,605,018 B2 3/2020 Schmidt
10,648,275 B2 5/2020 Dirocco
10,920,523 B2 2/2021 Kellner et al.
2003/0062171 A1 4/2003 Maguire et al.
2003/0099506 A1 5/2003 Mosing
2003/0188876 A1 10/2003 Vick et al.
2004/0060700 A1 4/2004 Vert et al.
2004/0069485 A1 4/2004 Ringgengberg et al.
2004/0177952 A1 9/2004 Turley et al.
2004/0244968 A1 12/2004 Cook et al.
2005/0011650 A1 1/2005 Harrall et al.
2005/0139359 A1 6/2005 Maurer et al.
2005/0189103 A1 9/2005 Roberts et al.
2005/0199401 A1 9/2005 Patel et al.
2005/0205266 A1 9/2005 Todd et al.
2005/0211446 A1 9/2005 Ricalton et al.
2005/0217866 A1 10/2005 Watson et al.
2006/0185855 A1 8/2006 Jordan et al.
2006/0272828 A1 12/2006 Manson
2007/0000664 A1 1/2007 Ring et al.
2007/0044958 A1 3/2007 Rytlewski et al.
2007/0272418 A1 11/2007 Corre et al.
2008/0066923 A1 3/2008 Xu
2008/0073074 A1 3/2008 Frazier
2008/0135248 A1 6/2008 Talley et al.
2008/0135261 A1 6/2008 McGilvray et al.
2008/0142223 A1 6/2008 Xu et al.
2008/0190600 A1 8/2008 Shkurti et al.

(56) References Cited

U.S. PATENT DOCUMENTS

| | | | |
|---|---|---|---|
| 2008/0264627 | A1 | 10/2008 | Roberts et al. |
| 2008/0308266 | A1 | 12/2008 | Roberts et al. |
| 2009/0044949 | A1 | 2/2009 | King et al. |
| 2009/0065192 | A1 | 3/2009 | Lucas |
| 2009/0065196 | A1 | 3/2009 | Holland et al. |
| 2009/0205843 | A1 | 8/2009 | Gandikota et al. |
| 2009/0242213 | A1 | 10/2009 | Braddick |
| 2009/0266560 | A1 | 10/2009 | Ring et al. |
| 2010/0032167 | A1 | 2/2010 | Adam et al. |
| 2010/0038072 | A1 | 2/2010 | Akselberg |
| 2010/0116489 | A1 | 5/2010 | Nelson |
| 2010/0132960 | A1 | 6/2010 | Shkurti et al. |
| 2010/0170682 | A1 | 7/2010 | Brennan, III |
| 2010/0263857 | A1 | 10/2010 | Frazier |
| 2010/0270031 | A1 | 10/2010 | Patel |
| 2010/0270035 | A1 | 10/2010 | Ring et al. |
| 2010/0276159 | A1 | 11/2010 | Mailand et al. |
| 2010/0314127 | A1 | 12/2010 | Swor et al. |
| 2010/0319427 | A1 | 12/2010 | Lohbeck |
| 2010/0319927 | A1 | 12/2010 | Yokley et al. |
| 2011/0005779 | A1 | 1/2011 | Lembcke |
| 2011/0048743 | A1 | 3/2011 | Stafford et al. |
| 2011/0088891 | A1 | 4/2011 | Stout |
| 2011/0132143 | A1 | 6/2011 | Xu et al. |
| 2011/0132619 | A1 | 6/2011 | Agrawal et al. |
| 2011/0132621 | A1 | 6/2011 | Agrawal et al. |
| 2011/0132623 | A1 | 6/2011 | Moeller |
| 2011/0232899 | A1 | 9/2011 | Porter |
| 2011/0240295 | A1 | 10/2011 | Porter et al. |
| 2011/0266004 | A1 | 11/2011 | Hallundbaek et al. |
| 2011/0284232 | A1 | 11/2011 | Huang |
| 2012/0024109 | A1 | 2/2012 | Xu et al. |
| 2012/0055669 | A1 | 3/2012 | Levin et al. |
| 2012/0067583 | A1 | 3/2012 | Zimmerman et al. |
| 2012/0097384 | A1 | 4/2012 | Valencia |
| 2012/0111566 | A1 | 5/2012 | Sherman et al. |
| 2012/0118583 | A1 | 5/2012 | Johnson et al. |
| 2012/0132426 | A1 | 5/2012 | Xu et al. |
| 2012/0168163 | A1 | 7/2012 | Bertoja et al. |
| 2012/0199341 | A1 | 8/2012 | Kellner et al. |
| 2012/0205873 | A1 | 8/2012 | Turley |
| 2012/0247767 | A1 | 10/2012 | Themig et al. |
| 2012/0273199 | A1 | 11/2012 | Cresswell et al. |
| 2013/0008671 | A1 | 1/2013 | Booth |
| 2013/0062063 | A1 | 3/2013 | Baihly et al. |
| 2013/0081825 | A1 | 4/2013 | Lynde et al. |
| 2013/0186615 | A1 | 7/2013 | Hallubaek et al. |
| 2013/0186616 | A1 | 7/2013 | Xu et al. |
| 2013/0192853 | A1 | 8/2013 | Themig |
| 2013/0299185 | A1 | 11/2013 | Xu et al. |
| 2014/0014339 | A1 | 1/2014 | O'Malley et al. |
| 2014/0076571 | A1 | 3/2014 | Frazier et al. |
| 2014/0131054 | A1 | 5/2014 | Raynal |
| 2014/0209325 | A1 | 7/2014 | Dockweiler |
| 2014/0224477 | A1 | 8/2014 | Wiese |
| 2014/0238700 | A1 | 8/2014 | Williamson |
| 2014/0262214 | A1 | 9/2014 | Mhaskar |
| 2014/0352970 | A1 | 12/2014 | Kristoffer |
| 2015/0027737 | A1 | 1/2015 | Rochen |
| 2015/0068757 | A1 | 3/2015 | Hofman et al. |
| 2015/0075774 | A1 | 3/2015 | Raggio |
| 2015/0129215 | A1 | 5/2015 | Xu et al. |
| 2015/0184485 | A1 | 7/2015 | Xu et al. |
| 2015/0218904 | A1 | 8/2015 | Chauffe et al. |
| 2016/0160591 | A1 | 6/2016 | Xu |
| 2016/0186511 | A1 | 6/2016 | Coronado et al. |
| 2016/0290096 | A1 | 10/2016 | Tse |
| 2016/0305215 | A1 | 10/2016 | Harris et al. |
| 2016/0312557 | A1 | 10/2016 | Kitzman |
| 2016/0333655 | A1* | 11/2016 | Fripp ..... E21B 43/08 |
| 2016/0376869 | A1 | 12/2016 | Rochen |
| 2017/0022781 | A1 | 1/2017 | Martin |
| 2017/0067328 | A1* | 3/2017 | Chauffe ..... E21B 34/14 |
| 2017/0101843 | A1 | 4/2017 | Waterhouse et al. |
| 2017/0130553 | A1 | 5/2017 | Harris |
| 2017/0218711 | A1 | 8/2017 | Kash |
| 2017/0260824 | A1 | 9/2017 | Kellner |
| 2018/0030807 | A1 | 2/2018 | Martin |
| 2018/0073325 | A1 | 3/2018 | Dolog |
| 2018/0266205 | A1 | 9/2018 | Martin et al. |
| 2018/0363409 | A1 | 12/2018 | Frazier |
| 2019/0106961 | A1 | 4/2019 | Hardesty |
| 2019/0203556 | A1 | 7/2019 | Powers |
| 2019/0264513 | A1 | 8/2019 | Kosel |
| 2019/0292874 | A1 | 9/2019 | Saeed |
| 2020/0072019 | A1 | 3/2020 | Tonti |
| 2020/0131882 | A1 | 4/2020 | Tonti |
| 2020/0173246 | A1 | 6/2020 | Kellner |
| 2020/0248521 | A1 | 8/2020 | Southard |
| 2020/0256150 | A1 | 8/2020 | Kellner |

FOREIGN PATENT DOCUMENTS

| | | | |
|---|---|---|---|
| EP | 2251525 | A1 | 11/2010 |
| GB | 2345308 | A | 7/2000 |
| GB | 2448449 | B | 12/2008 |
| GB | 2482078 | A | 1/2012 |
| WO | 2010/039131 | A1 | 4/2010 |
| WO | 2011/023743 | A2 | 11/2011 |
| WO | 2011/137112 | A2 | 11/2011 |
| WO | 2014/014591 | A1 | 1/2014 |
| WO | 2014/100072 | A1 | 6/2014 |
| WO | 2016/160003 | A1 | 10/2016 |
| WO | 2017/151384 | A1 | 9/2017 |

OTHER PUBLICATIONS

Chakraborty et al., Drilling and Completions Services and Capabilities Presentation, Jan. 2018, Virtual Integrated Analytic Solutions, Inc., 33 pages.

Gorra et al., Expandable Zonal Isolation Barrier (ZIB) Provides a Long-Term Well Solution as a High Differential Pressure Metal Barrier to Flow, Brazilian Petroleum Technical Papers, 2010, Abstract only, 1 page.

Hinkie et al., Multizone Completion with Accurately Placed Stimulation Through Casing Wall, SPE Production and Operations Symposium, Mar. 13-Apr. 3, 2007, pp. 1-4.

King et al., A Methodology for Selecting Interventionless Packer Setting Techniques, SPE-90678-MS, Society of Petroleum Engineers, 2004, pp. 1-3.

Larimore et al., Overcoming Completion Challenges with Interventionless Devices—Case Study—The "Disappearing Plug", SPE 63111, SPE International 2000, pp. 1-13.

Vargus et al., Completion System Allows for Interventionless Stimulation Treatments in Horizontal Wells with Multiple Shale Pay Zones, Annual SPE Technical Conference, Sep. 2008, Abstract only, 1 page.

Vargus et al., Completion System Allows for Interventionless Stimulation Treatments in Horizontal Wells with Multiple Shale Pay Zones, SPE Annual Technical Conference, Sep. 2008, pp. 1-8.

Vargus et al., System Enables Multizone Completions, The American Oil & Gas Reporter, 2009, Abstract only, 1 page.

World Oil, Slotted Liner Design for Sagd Wells ///, Jun. 2007, WorldOil.Com, https://www.worldoil.com/magazine/2007/june-2007/special-focus/slotted-liner-design-for-sagd-wells, 1 page.

* cited by examiner

DEFORMABLE DOWNHOLE TOOL WITH DISSOLVABLE ELEMENT AND BRITTLE PROTECTIVE LAYER

CROSS-REFERENCE TO RELATED APPLICATIONS

This application claims priority to U.S. Provisional Patent Application having Ser. No. 62/758,073, which was filed on Nov. 9, 2018 and is incorporated herein by reference in its entirety.

BACKGROUND

In the oilfield, fracturing (or "fracking") operations are employed to open preferential flowpaths in a subterranean formation, which may allow for economic access to and production from unconventional hydrocarbon reserves. In such fracturing operations, in general, a fracturing tool such as a frac plug or frac sleeve is deployed into the wellbore, the tool is then plugged, e.g., by deploying a ball onto a ball seat of the tool, and then pressurized fluid is deployed. The pressurized fluid can include water, proppants, acids, etc. The pressurized fluid meets the plugged tool and is diverted outward into the targeted formation. There are many variations on this process, with the foregoing being merely a simplified introduction.

Further, multiple formations at different depths may be fractured along a single well. This is referred to as multistage fracturing. Generally, multiple fracturing tools are positioned at intervals along the well. The operator then drops a ball, which passes by the shallower fracturing tools, until landing on the ball seat of the deepest tool, thereby plugging the deepest tool. Pressurized fluid is then injected into the formation immediately above the deepest tool. When treatment is complete, the next deepest tool is plugged, and the process is repeated, with injection occurring in the next deepest formation, isolated from the subjacent, deepest formation. This can be repeated for as many plugs/valves as are provided so as to treat the formations individually.

In such operations, the plugs and/or sleeves may obstruct the wellbore in order to perform their function of diverting the pressurized fluid into the wellbore. At some point, however, such obstruction is removed, e.g., to enable production of fluids from the formation. Typically, this is accomplished by flowing back (e.g., reversing fluid flow) to remove the ball from the tool, and then milling out the ball seat to return the tool to full bore diameter. However, milling out such ball seats can be costly and time-consuming.

Accordingly, dissolvable plugs have been used recently. Such dissolvable plugs may have one or more elements made from a material that is configured to dissolve in the wellbore environment (fluids) or by application of an additional fluid. An issue with such dissolvable plugs is premature dissolving, e.g., during run-in and/or before setting. To delay such early dissolving, protective materials are sometimes disposed on the exterior of the dissolvable components. When the dissolving process is to commence, the protective materials are typically eroded away using an abrasive material, or dissolve away at a reduced rate, which then exposes the dissolvable component to the wellbore.

SUMMARY

A downhole tool is disclosed. The downhole tool includes a component that is configured to dissolve in a wellbore fluid, and a protective coating applied to the component. The protective coating is configured to isolate the component from the wellbore fluid, and to fracture in response to the component deforming and expose the component to the wellbore fluid.

A method is disclosed. The method includes deploying a downhole tool into a wellbore. The downhole tool includes a component and a protective layer disposed on the component, wherein the component is dissolvable in a fluid of the wellbore, and the protective layer is configured to isolate the component from the fluid of the wellbore. The method also includes setting the downhole tool in the wellbore. Setting the downhole tool includes deforming the component, and deforming the component causes the protective layer to fracture and expose the component to the fluid of the wellbore.

A downhole tool is disclosed. The downhole tool includes a sleeve including an inner bore. The sleeve is at least partially made from a material configured to dissolve in a wellbore fluid. The tool further includes a first cone positioned at least partially in the inner bore. The first cone is configured to be moved farther into the sleeve. Moving the first cone farther into the sleeve deforms at least a portion of the sleeve radially outward and into engagement with a surrounding tubular. The tool also includes a second cone positioned at least partially in the inner bore. The second cone is configured to be moved farther into the sleeve. Moving the second cone farther into the sleeve deforms at least another portion of the sleeve radially outward and into engagement with the surrounding tubular. The tool includes a first protective coating disposed on the sleeve. The first protective coating is configured not to dissolve in the wellbore fluid, and the first protective coating is relatively brittle in comparison to the sleeve, such that the first protective coating fractures when the sleeve is deformed radially outward by movement of the first cone, the second cone, or both.

The foregoing summary is intended merely to introduce some aspects of the following disclosure and is thus not intended to be exhaustive, identify key features, or in any way limit the disclosure or the appended claims.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
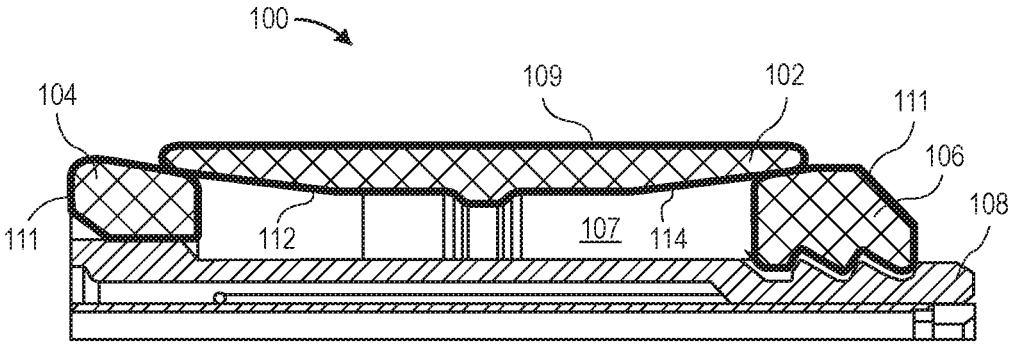
FIG. 1 illustrates a partial, cross-sectional view of an embodiment of the downhole tool, with a setting tool received therein prior to expansion.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a partial, side, cross-sectional view of a downhole tool 100, according to an embodiment. As shown, the downhole tool 100 includes a generally cylindrical sleeve 102 and first and second cones 104, 106 positioned at least partially within a bore 107 of the sleeve 102, on opposite axial sides thereof. The sleeve 102 may be configured to be deformed outward by adducting movement of the first and second cones 104, 106, so as to engage with a surrounding tubular (e.g., casing, liner, the wellbore wall, etc.). One example of such a downhole tool is provided in U.S. Patent Publication No. 2018/0266205, which is incorporated herein by reference in its entirety, to the extent not inconsistent with the present disclosure.

Further, the sleeve 102 may be dissolvable, i.e., made at least partially from a dissolvable material, such as magnesium, that is configured to dissolve in the wellbore environment. A (e.g., first) protective coating 109 may be applied or otherwise disposed on the sleeve 102. The protective coating 109 may at least partially isolate the sleeve 102 from the wellbore environment, at least while the downhole tool 100 is in the run-in configuration, e.g., prior to being set/deformed.

Similarly, one or both of the first and second cones 104, 106 may be made from a dissolvable material, such as magnesium. A first and/or second protective coating 111 may be applied or otherwise disposed on the outer surface of the first and/or second cones 104, 106, respectively. The protective coating 111 may isolate the first and/or second cones 104, 106 from the downhole environment, at least while the downhole tool 100 is in the run-in configuration.

An inner body 108 of a setting tool is coupled to the second cone 106 and is configured to apply an upwardly-directed (to the left in the figure) force on the second cone 106. For example, the inner body 108 includes teeth or threads that engage complementary teeth or threads of the second cone 106, until a predetermined setting force is reached, at which point the teeth of the second cone 106 yield or the setting tool otherwise releases therefrom. Other embodiments may include shearable members (pins, screws, rings, etc.), detents, or any other fastening/adhering member that provides a releasable connection between the inner body 108 and the second cone 106.

This upwardly-directed force draws the second cone 106 upward, toward the first cone 104. A setting sleeve (not shown) applies a downwardly-directed (to the right in the figure) force on the first cone 104. The combination of these forces causes the cones 104, 106 to advance farther into the sleeve 102, toward one another, until a predetermined force is required to further move the second cone 106. When this predetermined force is reached, the inner body 108 of the setting tool disengages from the second cone 106 and the setting tool is withdrawn from the downhole tool 100.

Figure 2:
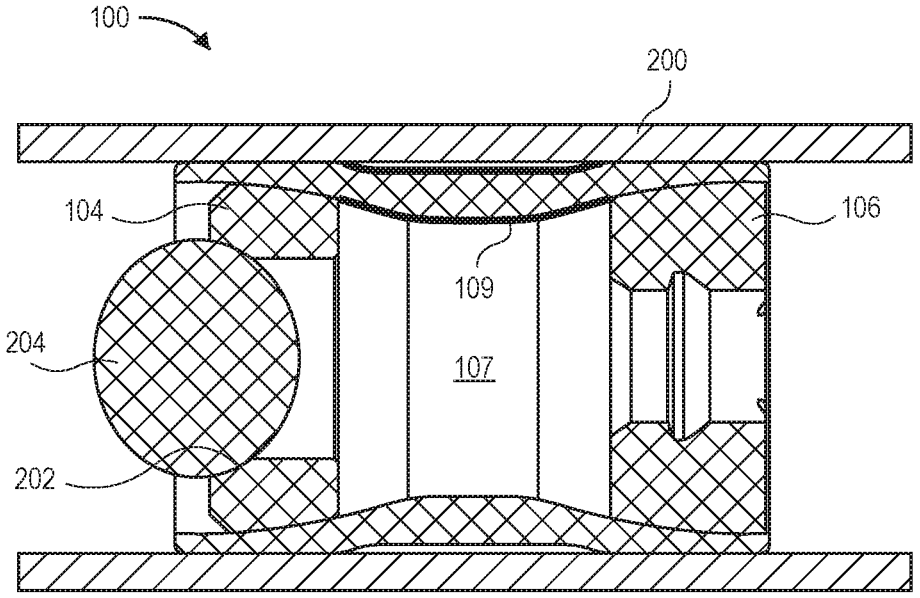
FIG. 2 illustrates a side, cross-sectional view of the downhole tool in a set configuration, with the setting tool removed, according to an embodiment.

Additional reference is now made to FIG. 2, illustrating a side, cross-sectional view of the downhole tool 100 in a set configuration in a surrounding tubular 200 (e.g., casing, liner, wellbore wall, etc.), according to an embodiment. The cones 104, 106 have tapered outer diameter surfaces, as shown. The bore 107 of the sleeve 102 may have complementary-tapered bore portions 112, 114. Accordingly, as the cones 104, 106 are moved farther into the sleeve 102 (e.g., towards one another), they incrementally or progressively press the sleeve 102 outward, thereby deforming the portions of the sleeve 102 that they engage radially outward.

FIG. 2 also illustrates the first cone 104 having a (e.g., tapered) seat 202, which faces upwards (to the left). An obstructing member 204 (e.g., ball) may be deployed into the wellbore and landed on the seat 202. The obstructing member 204 may at least partially seal with the seat 202, thereby blocking fluid flow through the bore 107 of the sleeve 102.

Deforming the sleeve 102 radially outward may fracture (e.g., break, crack, detach, or yield) the protective coating 109 from the sleeve 102. That is, the protective coating 109 may be unable to deform along with the sleeve 102 during the setting process. As a result, the protective coating 109 may no longer isolate the sleeve 102 from the wellbore environment, and thus the sleeve 102 may begin dissolving, either immediately or upon introduction of some other solvent fluid into the wellbore.

Similarly, the protective coating 111 may also break during the setting process, as the cones 104, 106 may deform inward as they move and press the sleeve 102 outward. In another embodiment, the protective coatings 109 and/or 111 may be scraped off by movement of the cones 104, 106. Thus, in either case, the protective coating 109, 111 may fracture and expose the dissolvable material therein to the wellbore environment by deforming the dissolvable material of the component being protected, and this deformation may be part of the setting process. This is illustrated in FIG. 2, as at least a portion of each of the coatings 109, 111 is missing (coating 111 on the cones 104, 106 is entirely removed in this example, although it may only be partially removed in practice). As such, separate actions, introduction of abrasive fluids, etc. related to removing the protective coating(s) 109, 111 may be avoided.

A variety of protective coatings 109, 111 may be employed consistent with the present disclosure. For example, such protective coatings 109, 111 may be less ductile or malleable than the material (e.g., magnesium) of the sleeve 102 and/or the cones 104, 106, leading to brittle fracture, for example, when the component to which they are applied is deformed. Examples of materials that may be employed for the protective coating 109, 111 include XYLAN®, FLOUROLON™, fiberglass resin, urethane, paste wax, or epoxy. In some embodiments, two or more such materials may be used for the protective coating 109, 111, e.g., in different layers. Further, the protective coating 109 may be made from a different material than, or from the same material as, the protective coating 111 (and the protective coating 111 on the cones 104, 106 may be different or the same). Similarly, the thickness, number of layers, etc., of the protective coatings 109, 111 and/or as between the protective coatings 111 on the different cones 104, 106 may be different or the same.

In at least one embodiment, the protective coating 109 may include particles or an abrasive material (e.g., sand or a composite material) that is configured to aid the sleeve 102 in gripping the surrounding tubular 200 as the protective coating 109 fractures during the setting process. Likewise, the protective coating 111 may include particles or an abrasive material to promote gripping engagement between the cones 104, 106 and the sleeve 102.

Figure 3:
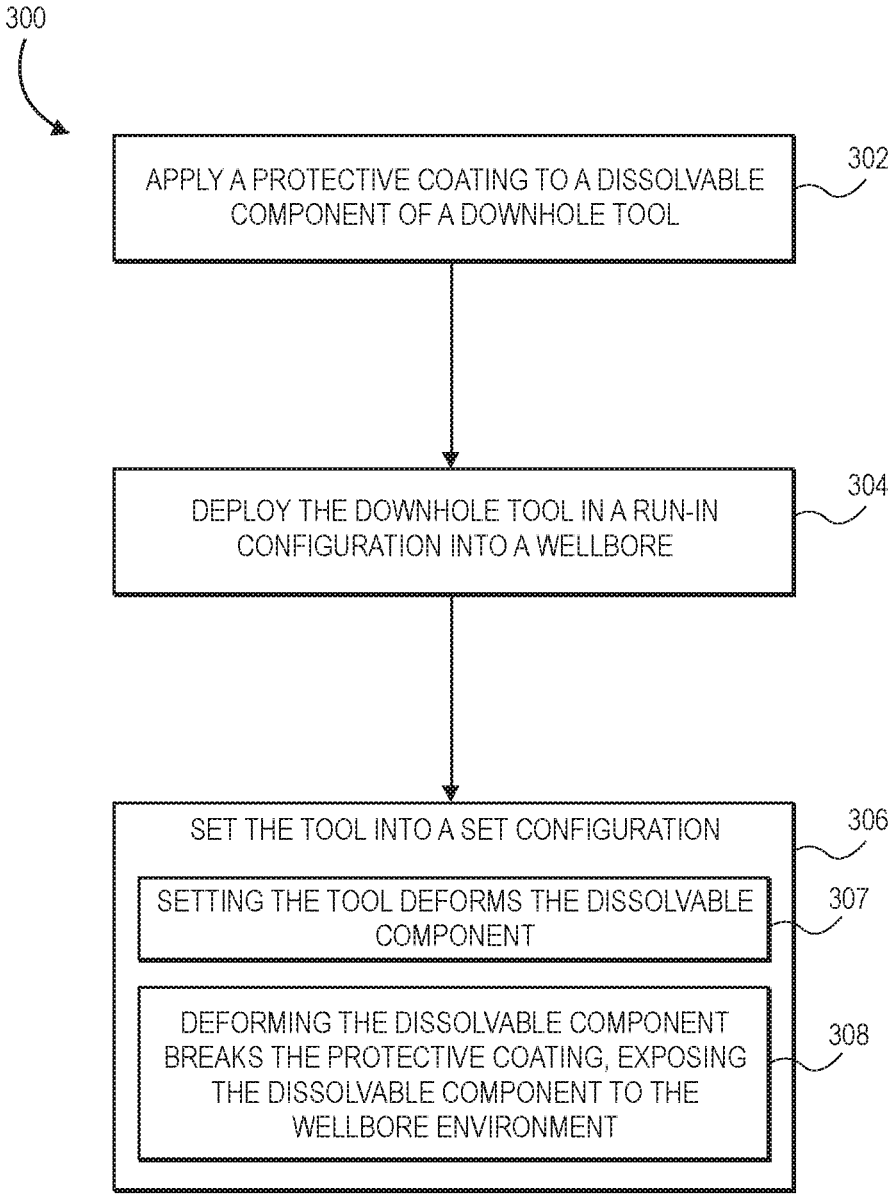
FIG. 3 illustrates a flowchart of a method for setting and removing a downhole tool, according to an embodiment.

FIG. 3 illustrates a flowchart of a method 300 for setting and removing a downhole tool in a wellbore, according to an embodiment. The method 300 may proceed using any embodiment of the downhole tool 100 discussed above or may also use other tools. As such, the method 300 should not be considered limited to any particular structure unless otherwise specified herein.

The method 300 may include applying a protective coating 109 and/or 111 to a component of the downhole tool 100, as at 302. For example, the component may be a sleeve 102 of the downhole tool 100. In other examples, the component may be a first cone 104 and/or a second cone 106, other parts of the downhole tool 100, or another tool. The protective coating 109, 111 may be relatively brittle in comparison to the component to which it is applied.

The method 300 may include deploying the downhole tool 100, with the protective coating(s) 109 and/or 111 applied thereto, in a run-in configuration into a wellbore, as at 304. The wellbore environment may include fluid solvents that would dissolve the component of the downhole tool 100 if allowed into contact therewith; however, because the protective coating 109 and/or 111 is present and isolates the component, the component may not dissolve during run-in.

Once the downhole tool 100 reaches a desired location or depth in the wellbore, the method 300 may proceed to setting the tool 100, as at 306. Setting the downhole tool 100 may include deforming the component, as indicated at 307. For example, if the component is the sleeve 102, deforming the component may include adducting first and second cones 104, 106 together within the bore 107 of the sleeve 102, thereby deforming the sleeve 102 radially outward. In some embodiments, setting the tool 100 may include inwardly-deforming the cones 104, 106 (e.g., where the cones 104, 106 provide the component), as the cones 104, 106 in turn deform the sleeve 102.

Deforming the component (e.g., the sleeve 102 and/or the cones 104, 106) fractures at least a portion of the protective coating 109, as indicated at 308. As such, the deforming the component results in the component being exposed to the fluids in the wellbore, and thus beginning to dissolve. As such, separate abrasion or other processes to erode or otherwise remove the protective coating 109, 111 may be omitted, as the setting process not only sets the tool 100 in the wellbore, but also breaks the protective coating 109, 111 and initiates the dissolving process.

Before the dissolving process is complete, however, the tool 100 may operate as a plug, isolating one well zone from another. For example, an obstructing member 204 may be deployed into the tool 100 and landed on a seat 202 of the first cone 104. The combination of the obstructing member 204, the first cone 104, and the sleeve 102 may prevent fluid flow downward (to the right in FIG. 2) through the tool 100.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a component that is configured to dissolve in a wellbore fluid, wherein the component comprises a sleeve that is configured to be set to engage a surrounding tubular;

a protective coating applied to the component, wherein the protective coating is configured to isolate the component from the wellbore fluid, and wherein the protective coating is configured to fracture in response to the component deforming and expose the component to the wellbore fluid; and one or more cones that are configured to move within the sleeve to set the sleeve, which deforms the sleeve radially outward to engage the surrounding tubular, wherein the one or more cones radially deforming the sleeve mechanically fractures the protective coating, such that setting the sleeve in the surrounding tubular causes the protective coating to fracture, and wherein the one or more cones are configured to receive an obstructing member therein after the protective coating is mechanically fractured, which at least partially blocks fluid flow through the sleeve, causing a pressure of the wellbore fluid to increase.

2. The downhole tool of claim 1, wherein the protective coating comprises a material selected from the group consisting of XYLAN®, FLOUROLON™, fiberglass resin, urethane, paste wax, and epoxy.

3. The downhole tool of claim 1, wherein the protective coating comprises a material that is relatively brittle in comparison to a material of the component.

4. The downhole tool of claim 1, wherein the one or more cones comprise a first cone that is moved by engagement with a setting tool.

5. The downhole tool of claim 4, wherein the one or more cones further comprise a second cone that is moved by engagement with the setting tool, to deform the sleeve radially outward.

6. The downhole tool of claim 4, wherein the first cone comprises:

a dissolvable material; and a protective coating covering the dissolvable material of the first cone, the protective coating of the first cone being configured to isolate the dissolvable material of the first cone from the wellbore fluid, wherein, when the one or more cones deform the sleeve during setting, the one or more cones are also deformed radially inwards, which fractures the protective coating on the first cone and exposes the dissolvable material of the first cone to the wellbore fluid, such that the dissolvable material of the first cone dissolves.

7. The downhole tool of claim 1, wherein the one or more cones are configured to move within the sleeve to set the sleeve in response to opposing axial forces exerted by a setting tool.

8. A method, comprising:

deploying a downhole tool into a wellbore, wherein the downhole tool comprises a deformable sleeve and a protective layer disposed on the deformable sleeve, wherein the deformable sleeve comprises a dissolvable material that is dissolvable in a fluid of the wellbore, and wherein the protective layer is configured to isolate the dissolvable material from the fluid of the wellbore; and setting the downhole tool in the wellbore by pressing one or more cones axially into the sleeve, such that the sleeve is deformed radially outward into engagement with a surrounding tubular by the one or more cones, wherein deforming the deformable sleeve both sets the downhole tool in the surrounding tubular and mechanically fractures the protective layer, exposing the dissolvable material to the fluid of the wellbore, and wherein the one or more cones are configured to receive an obstructing member therein after the protective layer is mechanically fractured, which at least partially blocks fluid flow through the deformable sleeve, causing a pressure of the fluid to increase.

9. The method of claim 8, wherein the protective layer is configured to fracture without being eroded by introduction of an abrasive fluid to the downhole tool.

10. The method of claim 8, wherein the dissolvable material at least partially dissolves in the wellbore fluid after the protective layer fractures, and wherein the protective layer does not dissolve in the wellbore fluid.

11. The method of claim 8, wherein the protective layer is made at least partially from a material that is relatively brittle in comparison to the dissolvable material of the sleeve.

12. The method of claim 8, wherein setting the downhole tool comprises moving first and second cones of the one or more cones together within a bore of the deformable sleeve, such that the deformable sleeve is deformed radially outward and into engagement with the surrounding tubular, and wherein the deformable sleeve being deformed radially outward by movement of the first and second cones fractures the protective coating.

13. The method of claim 12, further comprising deploying the obstructing member into the wellbore after setting the downhole tool, wherein the first cone comprises a seat that catches the obstructing member.

14. A downhole tool, comprising:

a sleeve comprising an inner bore, wherein the sleeve is at least partially made from a material configured to dissolve in a wellbore fluid;

a first cone positioned at least partially in the inner bore, wherein the first cone is configured to be moved farther into the sleeve, and wherein moving the first cone farther into the sleeve deforms at least a portion of the sleeve radially outward and into engagement with a surrounding tubular;

a second cone positioned at least partially in the inner bore, wherein the second cone is configured to be moved farther into the sleeve, and wherein moving the second cone farther into the sleeve deforms at least another portion of the sleeve radially outward and into engagement with the surrounding tubular; and a first protective coating disposed on the sleeve, wherein the first protective coating is configured not to dissolve in the wellbore fluid, wherein the first protective coating is relatively brittle in comparison to the sleeve, such that the first protective coating fractures when the sleeve is deformed radially outward by movement of the first cone, the second cone, or both, and wherein the first cone is configured to receive an obstructing member therein after the first protective coating is fractured, which at least partially blocks fluid flow through the sleeve, causing a pressure of the wellbore fluid to increase.

15. The downhole tool of claim 14, further comprising a second protective coating disposed on the first cone, wherein the first cone is configured to dissolve in the wellbore fluid, wherein the second protective coating is configured not to dissolve in the wellbore fluid, and wherein the second protective coating is relatively brittle in comparison to the first cone, such that the second protective coating is at least partially removed by movement of the first cone with respect to the sleeve.

16. The downhole tool of claim 15, wherein the first cone comprises an upwardly-facing seat for catching the obstructing member to block fluid flow through the inner bore.

17. The downhole tool of claim 16, further comprising a third protective coating disposed on the second cone, wherein the second cone is configured to dissolve in the wellbore fluid, wherein the third protective coating is configured not to dissolve in the wellbore fluid, and wherein the third protective coating is relatively brittle in comparison to the second cone, such that the third protective coating is at least partially removed by movement of the second cone with respect to the sleeve.

18. The downhole tool of claim 14, wherein the first coating comprises a material selected from the group consisting of XYLAN®, FLOUROLON™, fiberglass resin, urethane, paste wax, and epoxy.

* * * * *